United States Patent [19]

Nicodemus

[11] Patent Number: 4,673,335

[45] Date of Patent: Jun. 16, 1987

[54] GAS COMPRESSION WITH HYDROKINETIC AMPLIFIER

[75] Inventor: Carl D. Nicodemus, Caledonia, N.Y.

[73] Assignee: Helios Research Corp., Mumford, N.Y.

[21] Appl. No.: 730,087

[22] Filed: May 3, 1985

Related U.S. Application Data

[63] Continuation-in-part of Ser. No. 612,742, May 21, 1984, Pat. No. 4,569,635.

[51] Int. Cl.[4] ..... F04F 5/00

[52] U.S. Cl. ..... 417/54; 417/151; 417/174; 417/197

[58] Field of Search ..... 417/54, 151, 174, 196–198, 417/167

[56] References Cited

U.S. PATENT DOCUMENTS

| | | | |
|---|---|---|---|
| 200,901 | 3/1878 | Dreyfus | 417/167 |
| 1,328,139 | 1/1920 | Elliott, Jr. | 417/54 |
| 1,495,150 | 5/1924 | Bancel et al. | 417/167 |
| 2,107,340 | 2/1938 | Pedrick | 417/174 X |
| 2,164,263 | 6/1939 | Wall | 417/198 X |
| 3,315,879 | 4/1967 | Jennings | 417/87 X |
| 3,456,456 | 7/1969 | Reitdijk | 417/151 X |
| 4,416,856 | 11/1983 | Durand et al. | 417/151 X |

FOREIGN PATENT DOCUMENTS

| | | | |
|---|---|---|---|
| 898171 | 6/1962 | United Kingdom | 417/174 |

*Primary Examiner*—Carlton R. Croyle
*Assistant Examiner*—Paul F. Neils
*Attorney, Agent, or Firm*—Stonebraker, Shepard & Stephens

[57] ABSTRACT

A hydrokinetic amplifier 10 that combines a liquid and vapor to produce an amplified liquid output pressure is used for compressing or liquifying gas by admitting gas to be compressed into a region where the liquid and vapor are in contact and the vapor is accelerating the liquid. The admitted gas is allowed to merge with the liquid and vapor and become compressed or liquified within the pressurized liquid output. A mixture of liquid and compressed gas can be used directly for purposes such as cleaning, or the liquid and compressed or liquified gas phases can be separated in the output so that either one or both can be used.

23 Claims, 3 Drawing Figures

GAS COMPRESSION WITH HYDROKINETIC AMPLIFIER

RELATED APPLICATIONS

This application is a continuation-in-part of my copending parent application Ser. No. 612,742, filed May 21, 1984, now U.S. Pat. No. 4,569,635, issued Feb. 11, 1986, entitled HYDROKINETIC AMPLIFIER, the disclosure of which is hereby incorporated by reference into this application.

BACKGROUND

A hydrokinetic amplifier, as explained more fully in my U.S. Pat. No. 4,569,635, forms a free liquid jet clear of internal walls and surrounds the liquid jet with a high velocity vapor that can condense or dissolve into the liquid. The vapor efficiently accelerates the liquid and transfers a large portion of its substantial momentum to accelerate the liquid through a nozzle. In the acceleration process, the vapor merges with the accelerated liquid whose increased kinetic energy is converted to pressure in a diffuser.

I have discovered that gases can be admitted to my hydrokinetic amplifier to merge with the liquid and vapor and become compressed in the pressurized liquid output. Surprisingly, such admission of gases to my hydrokinetic amplifier does not noticeably reduce the pressure of its liquid output. Also, gases can be admitted to my hydrokinetic amplifier at surprisingly large flow rates, making my hydrokinetic amplifier practically effective as a gas compressor.

I have found that compressed gas merged with the pressurized liquid output from my hydrokinetic amplifier has many practical uses. For example, the mixture of compressed gas and liquid can be used directly for cleaning purposes, or the compressed gas can be separated from the liquid for use separately or to serve as a compressible medium in a pressurized storage reservoir. Gas can also be compressed sufficiently to be liquified in the output from my hydrokinetic amplifier, and the operating liquid and the liquified gas can be thereafter separated for independent uses.

SUMMARY OF THE INVENTION

I compress gas with a hydrokinetic amplifier that combines a liquid and vapor to produce a liquid output at an amplified pressure, and I admit the gas to be compressed into the hydrokinetic amplifier in a region where the liquid and vapor are in contact and the vapor is surrounding and accelerating the liquid. I allow the admitted gas to merge with the liquid and vapor and become compressed in the pressurized liquid output from the hydrokinetic amplifier. For some purposes, I use the mixture of compressed or liquified gas and pressurized liquid output directly, and for other purposes, I separate the compressed or liquified gas from the operating liquid for independent use. My invention includes both method and structure for arranging and operating a hydrokinetic amplifier so as to compress or liquify gas.

DRAWINGS

DETAILED DESCRIPTION

My U.S. Pat. No. 4,569,635 provides a thorough explanation for the structuring and operating of hydrokinetic amplifiers. The herein incorporated disclosure of that U.S. application has been published as PCT Application No. 84/01162, filed July 25, 1984, entitled HYDROKINETIC AMPLIFIER.

Figure 1:
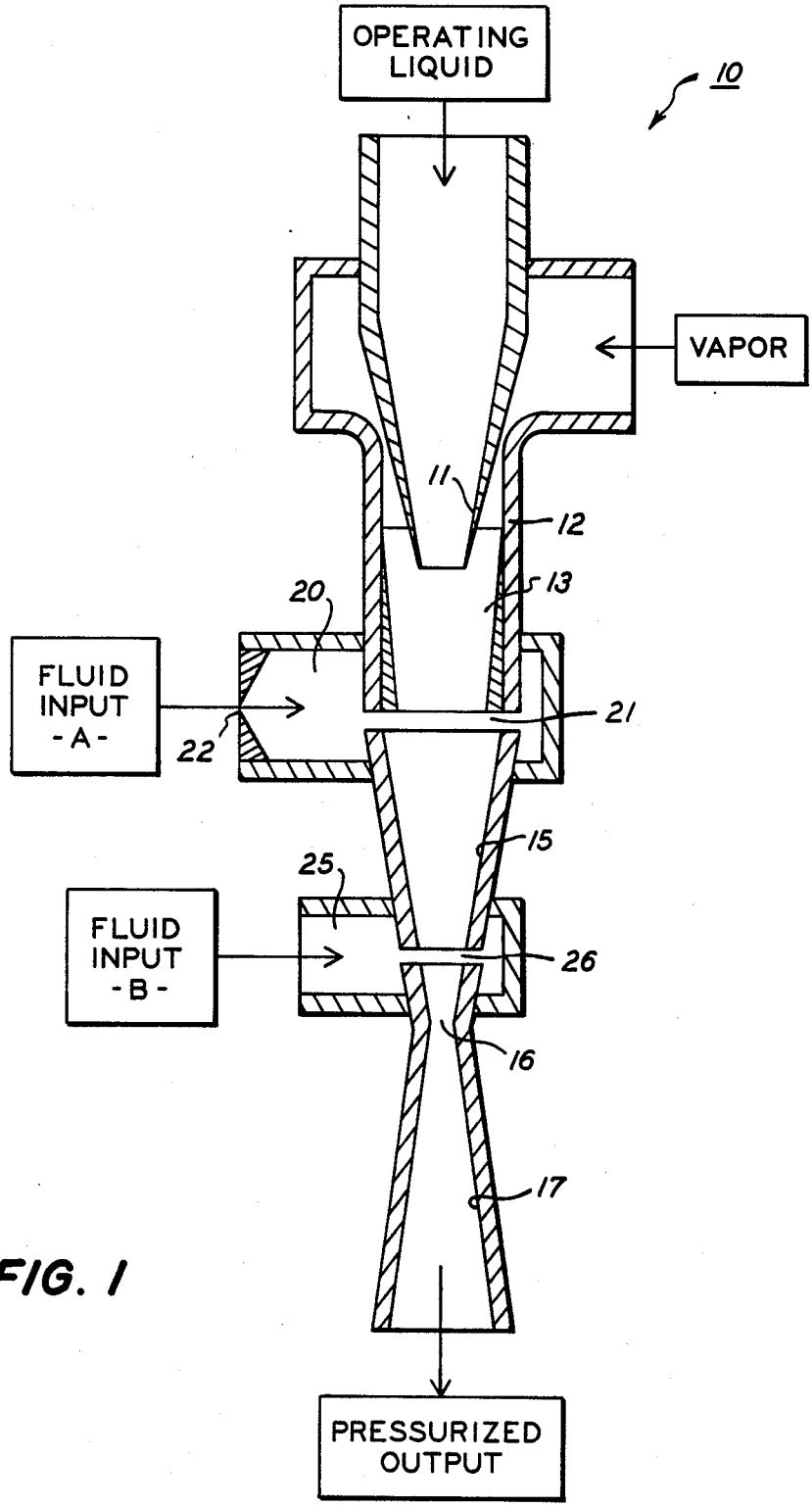
FIG. 1 is a partially schematic, cross-sectional view of a preferred embodiment of my hydrokinetic amplifier arranged for compressing gas.

Briefly, the hydrokinetic amplifier 10, used for compressing or liquifying gas according to the subject matter of this application, combines a liquid and vapor as schematically shown in FIG. 1 to produce a pressurized liquid output. An operating liquid, which can be a variety of liquid materials, enters hydrokinetic amplifier 10 through nozzle 11, which accelerates the liquid into a free liquid jet flowing clear of internal walls of hydrokinetic amplifier 10. A vapor condensable or dissolvable in the operating liquid enters hydrokinetic amplifier 10 through a vapor nozzle 12 that surrounds liquid nozzle 11 and accelerates the vapor to a high velocity before contacting the liquid jet. As the speeding vapor molecules impinge on the free liquid jet, they condense or dissolve in the liquid and transfer their substantial momentum to the liquid molecules. This accelerates the liquid away from liquid nozzle 11.

The accelerating liquid jet and the merging vapor causing the liquid to accelerate proceed through a nozzle 15 to a minimum cross-sectional area 16 where most of the fluid flow is liquid and the liquid attains its maximum velocity. There, the liquid engages the wall of a diffuser 17 that converts kinetic energy to pressure, forming a pressurized liquid output. Hydrokinetic amplifier 10 is efficient enough so that the absolute pressure of the liquid output can be four or more times the sum of the absolute pressures of the incoming liquid and vapor.

I have discovered that gases can be admitted to hydrokinetic amplifier 10 to merge with the liquid and vapor and become compressed in the pressurized liquid output from diffuser 17. I have found several ways of accomplishing this and have discovered that gases admitted to and compressed by hydrokinetic amplifier 10 surprisingly do not reduce the normal operating pressure of the output. In fact, admitting gas to be compressed in the liquid output from hydrokinetic amplifier 10 has been observed under some circumstances to increase the output pressure by several percent. I have also found several practical ways of using liquid and compressed or liquified gaseous outputs, including direct uses and separation and independent uses of pressurized output fluids.

I admit gas to be compressed to a region of hydrokinetic amplifier 10 where vapor is in contact with and is accelerating liquid. This locates suitable gas-admitting passageways to the region between the discharge of liquid nozzle 11 and minimum cross section of nozzle 16. In FIG. 1, I have schematically shown two preferred gas-admitting passageways within this region.

A gaseous or fluid input A can occur in a passageway 20 leading to a gap or opening 21 downstream of a mixing chamber 13 where vapor makes initial contact with liquid and upstream of nozzle 15 that converges the liquid and vapor flow toward minimum cross-sectional area 16. I have found that gas-admitting passageway 20 cannot be freely opened to atmosphere without stalling hydrokinetic amplifier 10, so I prefer a constriction 22 to limit the gas inflow when gas is admitted via passageway 20.

With moderate liquid and vapor pressures typically available in industrial locations, hydrokinetic amplifier 10 produces a subatmospheric pressure at gap or inlet 21. This allows atmospheric air, and even subatmospheric pressure gases or vapors, to be drawn into hydrokinetic amplifier 10 through passageway 20 via constriction 22.

Passageway 20 is also useful for introducing liquids into the fluid flow through hydrokinetic amplifier 10. Cleaning chemicals are one example of liquids that can be admitted via passageway 20, and liquid injection into gap 21 is preferably metered and regulated compatibly with the end use of the pressurized output, which can be for cleaning or other purposes.

I also prefer admitting gases to be compressed at fluid input B via passageway 25 to a gap 26 in nozzle 15. I prefer locating gap 26 proximate to and upstream of minimum cross-sectional area 16, and I have found that gap 26 can work well when spaced upstream of region 16 by 2–5 times the diameter of minimum region 16. I prefer that the inside diameter on the downstream side of gap 26 be slightly larger than the inside diameter on the upstream side of gap 26. I also prefer that the converging angle of nozzle 15 be slightly larger downstream of gap 26 than upstream of gap 26.

Operation of hydrokinetic amplifier 10 normally produces subatmospheric pressure in the high velocity liquid and vapor rushing through gap 26 so that gases at atmospheric pressure are readily drawn into gap 26. I have found that passageway 25 can be open to atmosphere without reducing the output pressure available from hydrokinetic amplifier 10 so that no constriction is necessary in passageway 25.

In practice, I have found that hydrokinetic amplifier 10 works at least as well with passageway 25 open as closed. There is even some evidence that admitting air through passageway 25 to the fluid flow through gap 26 helps the flow proceed more smoothly through minimum cross-sectional region 16 and reduces internal erosion. Admitting air through gap 26 has been observed to increase the output liquid pressure, and there is evidence that air compressed in the liquid output reduces cavitation that can otherwise occur from vapor collapsing in diffuser 17.

A gaseous inflow rate through gap 26 is also self-regulating. Liquid and vapor inputs that produce high output pressures from hydrokinetic amplifier 10 also produce a high fluid velocity through gap 26 and draw in gas to be compressed at a high flow rate. In contrast, liquid and vapor inputs producing lower output pressures that cannot compress a gaseous inflow at such a high rate also produce a lower fluid velocity through gap 26, and this draws in gas at a lower flow rate compatible with the output performance.

Hydrokinetic amplifier 10 can be operated with a variety of liquids and vapors, including water and steam, and refrigerant fluids such as freons and ammonias. There is reason to believe that hydrokinetic amplifier 10 can operate satisfactorily with any liquid and any vapor that is condensable or dissolvable in that liquid. Hydrokinetic amplifier 10 can also operate on subatmospheric pressure vapor while compressing gas in a super atmospheric output. This ability can take advantage of low pressure and temperature sources of vapor, which can be applied to gas compression work. For example, atmospheric pressure vapor can produce a pressurized output compressing a gas to 500 psi by operating hydrokinetic amplifier 10 in a feedback mode.

There is also no apparent limitation on the gaseous materials that hydrokinetic amplifier 10 can compress or liquify. These include air, vapors, pure gases, and mixtures of gases or gases and vapors. Vapor compressed in hydrokinetic amplifier 10 can differ from the vapour input through vapor nozzle 12 for powering hydrokinetic amplifier 10, and yet a vapor being compressed also can be condensable or dissolvable in the liquid output from hydrokinetic amplifier 10. Also, since hydrokinetic amplifier 10 can produce substantial output pressures, reaching at least to several thousand psi, gases admitted to hydrokinetic amplifier 10 can be compressed sufficiently to be liquified.

Hydrokinetic amplifier 10 can be operated both single pass with an operating liquid admitted via nozzle 11 and expended in the pressurized liquid output, and in a feedback mode in which liquid input to nozzle 11 is drawn from the pressurized liquid output from hydrokinetic amplifier 10. An example of operation in the feedback mode is shown in FIG. 3 where pressurized operating liquid is returned as an input to hydrokinetic amplifier 10 via cooler 30, which can also be arranged upstream of reservoir 40.

Figure 2:
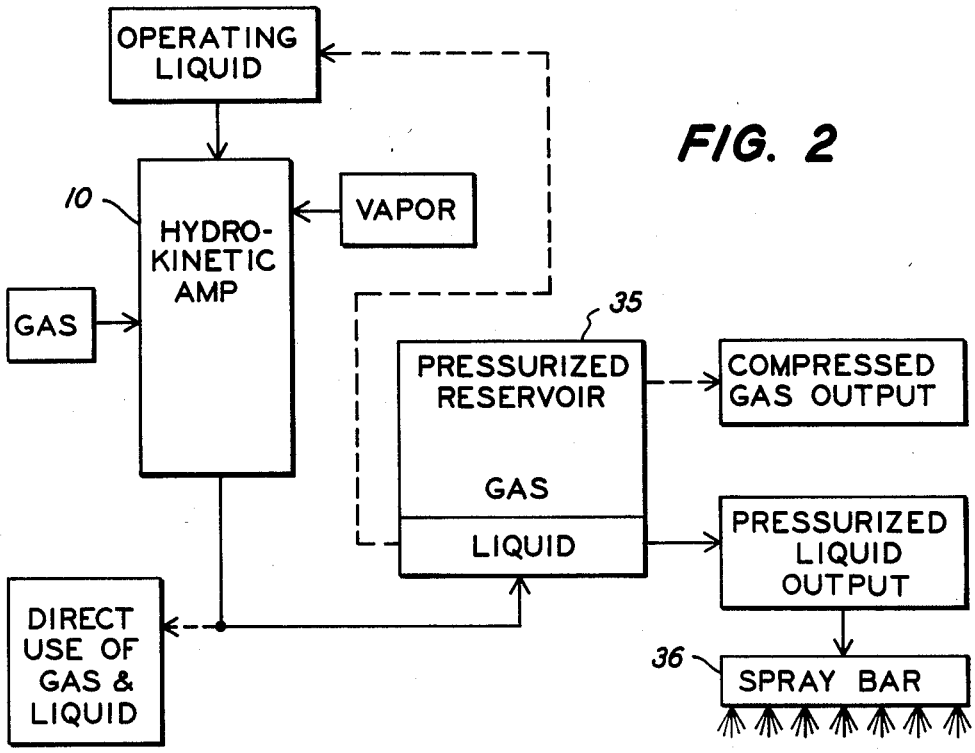
FIG. 2 is a schematic diagram of a preferred arrangement for compressing gas with a hydrokinetic amplifier according to my invention.
Figure 3:
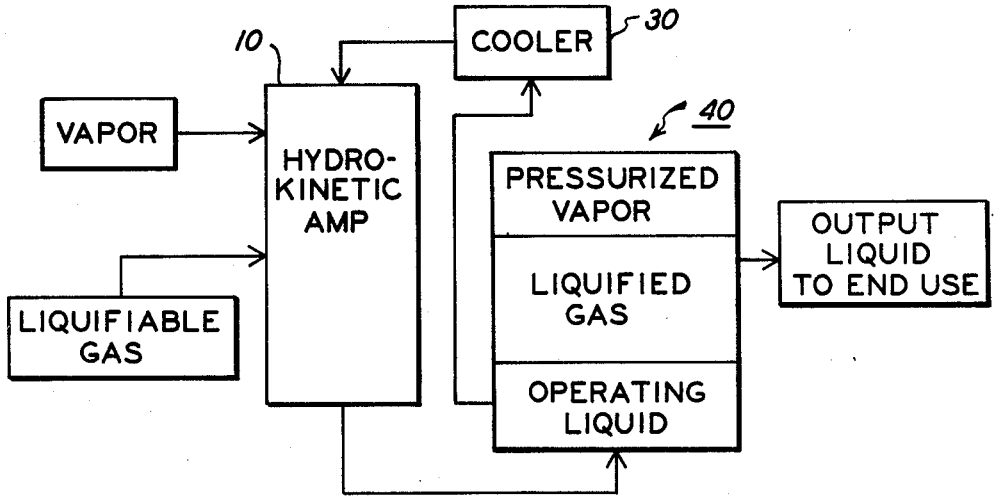
FIG. 3 is a schematic diagram of another preferred arrangement for compressing and liquifying gas with a hydrokinetic amplifier.

Schematically shown in FIGS. 2 and 3 are several of the many possible arrangements for compressing or liquifying gas with hydrokinetic amplifier 10. One possibility, as shown in FIG. 2, is direct use of the mixture of compressed gas and liquid. Although there may be many other uses for such a mixture, I have found it to be very effective as a cleaning spray. In fact, there is some evidence that compressed air mixed with pressurized water and delivered through a spray nozzle has a greater agitational cleaning effect than a solid water spray.

Compressed gas and liquid can also be separated before use, and a preferred way to do this is with a pressurized reservoir 35 as schematically shown in FIG. 2. Compressed air or other gases will separate from a pressurized liquid output in a pressure-containing tank or reservoir 35. The gas compressed in container 35 can serve as a resilient force maintaining the pressure on the uncompressible liquid which can be delivered to a pressurized liquid output. Uses for this can include anything that pressurized liquid can accomplish, including a spray bar 36 as shown schematically in FIG. 2.

Compressed gas from reservoir 35 or other gas and liquid separating device can also be used directly as the output material. Compressed air, for example, can power any of the multitude of systems using compressed air, especially if moisture is removed from the compressed air. Compressed gas output is also not limited to air and can include other gases and vapors. The gas or vapor to be compressed can also be drawn from a subatmospheric pressure supply, with hydrokinetic amplifier 10 serving as both a vacuum pump and compressor. Moreover, pressurized liquid from reservoir 35 can be fed back as the liquid supply to hydrokinetic amplifier 10 for operation in a feedback mode.

The ability of hydrokinetic amplifier 10 to liquify a compressed gas leads to other possible uses as schematically shown in FIG. 3. An operating liquid and a liquified gas can be separated in reservoir 40, which can also have a pressure head maintained by pressurized gas or vapor. The operating liquid can be fed back via cooler 30 to hydrokinetic amplifier 10 for operation in a feedback mode to produce especially high output pressures. The liquified gas can be used in refrigeration or cooling circuits or can be bottled and shipped or used for any purpose achievable with liquified gas.

I claim:

1. A method of entraining gas in a liquid jet for compressing the entrained gas, said method comprising:

a. forming said liquid jet within a hydrokinetic amplifier by feeding a portion of the pressurized liquid output from said hydrokinetic amplifier back to a liquid input to said hydrokinetic amplifier to give said jet a high initial velocity that is accelerated within said hydrokinetic amplifier by a motivating vapor surrounding and condensing in said jet;

b. via an inlet to said hydrokinetic amplifier, admitting uncompressed gas to the accelerating liquid jet within proximity to a minimum cross-sectional flow area of said hydrokinetic amplifier so that said gas merges with said jet and becomes compressed in said pressurized liquid output; and c. separating compressed gas from said pressurized liquid output in a pressurized separation reservoir supplied with said pressurized liquid output and supplying pressurized liquid for input to said hydrokinetic amplifier.

2. The method of claim 1 including cooling the pressurized liquid input to said hydrokinetic amplifier.

3. The method of claim 1 including removing liquid from said pressurized reservoir.

4. The method of claim 1 including removing compressed gas from said pressurized reservoir.

5. The method of claim 1 including cooling liquid drawn from said pressurized reservoir for input to said hydrokinetic amplifier.

6. The method of claim 1 including compressing said gas sufficiently to liquify said gas and removing the liquified gas from said pressurized reservoir.

7. A gas compressor comprising:

a. a hydrokinetic amplifier having a pressurized liquid output line leading to a pressurized separation reservoir;

b. a pressurized liquid input line leading from said separation reservoir to a liquid input to said hydrokinetic amplifier for forming within said hydrokinetic amplifier a free liquid jet with a high initial velocity;

c. a line for admitting motivating vapor to said hydrokinetic amplifier to surround, condense in, and accelerate said free liquid jet through said hydrokinetic amplifier; and d. a line for admitting uncompressed gas into entrainment with said free liquid jet within proximity to a minimum cross-sectional flow area of said hydrokinetic amplifier so that said gas is compressed in said pressurized liquid output line downstream of said minimum cross-sectinal flow area.

8. The gas compressor of claim 7 including a cooler arranged within said pressurized liquid input line.

9. The gas compressor of claim 7 including means for withdrawing pressurized gas from said separation reservoir.

10. The gas compressor of claim 7 wherein the gas input line admits gas to a merger region of said hydrokinetic amplifier upstream of said minimum cross-sectional flow area.

11. The gas compressor of claim 7 arranged for compressing said gas sufficiently to liquify said gas.

12. The gas compressor of claim 11 including means for withdrawing liquified gas from said separation reservoir.

13. A system of compressing and delivering gas, said system comprising:

a. entraining uncompressed gas in a free liquid jet surrounded by and accelerated by high velocity vapor condensing in said free liquid jet so that the entrained gas merges with said free liquid jet in a region within proximity to a minimum cross-sectional flow area of a hydrokinetic amplifier and is compressed within a pressurized liquid output from said hydrokinetic amplifier downstream of said minimum cross-sectional flow area;

b. separating the compressed gas from said pressurized liquid output in a separation reservoir downstream of said hydrokinetic amplifier; and c. drawing pressurized liquid from said separation reservoir for input to said hydrokinetic amplifier to form said free liquid jet at a high initial velocity.

14. The system of claim 13 including withdrawing liquid from said separation reservoir.

15. The system of claim 13 including cooling the liquid drawn from said reservoir for input to said hydrokinetic amplifier.

16. The system of claim 13 including compressing said gas sufficiently to liquify said gas.

17. The system of claim 16 including withdrawing liquified gas from said separation reservoir.

18. A gas compressor using a jet for entraining and compressing gas, said compressor comprising:

a. a hydrokinetic amplifier arranged for creating said jet with feedback means for deriving liquid for said jet from a pressurized liquid output of said hydrokinetic amplifier, said pressurized liquid output being input to said hydrokinetic amplifier to give said jet a high initial velocity that is accelerated through said hydrokinetic amplifier by a motivating vapor surrounding and condensing in said jet;

b. an inlet to said hydrokinetic amplifier for admitting uncompressed gas to merge with said jet within proximity to a minimum cross-sectional flow area of said hydrokinetic amplifier so that said gas is compressed in said pressurized liquid output downstream of said minimum cross-sectional flow area; and c. a pressurized separation reservoir receiving from said hydrokinetic amplifier said pressurized liquid output containing compressed gas and supplying pressurized liquid for said feedback means.

19. The gas compressor of claim 18 including means for withdrawing liquid from said reservoir.

20. The gas compressor of claim 18 including a cooler in a pressurized liquid feedback line between said reservoir and an input to said hydrokinetic amplifier.

21. The gas compressor of claim 18 wherein said gas admitting means is upstream of said minimum cross-sectional flow area within said hydrokinetic amplifier.

22. The gas compressor of claim 18 arranged for compressing said gas sufficiently to liquify said gas.

23. The gas compressor of claim 22 including means for withdrawing the liquified gas from said pressurized separation reservoir.

* * * * *